United States Patent [19]

Knowlton

[11] 4,292,257

[45] Sep. 29, 1981

[54] CARBURETOR AND VALVING THEREFOR

[76] Inventor: Lloyd L. Knowlton, P.O. Box 136, Walkerton, Ind. 46574

[21] Appl. No.: 112,024

[22] Filed: Jan. 14, 1980

[51] Int. Cl.[3] ..... F02M 11/10

[52] U.S. Cl. ..... 261/37; 261/41 B; 261/44 A; 261/44 G; 261/67; 261/DIG. 56; 261/DIG. 74

[58] Field of Search ..... 261/41 B, 44 A, 44 G, 261/37, 67, DIG. 74, DIG. 56

[56] References Cited

U.S. PATENT DOCUMENTS

| | | | |
|---|---|---|---|
| 1,125,069 | 1/1915 | Coulter | 261/41 B |
| 1,142,763 | 6/1915 | Perry | 261/41 B |
| 1,198,789 | 9/1916 | Teed | 261/44 A |
| 1,688,285 | 10/1928 | Purvis et al. | 261/44 A |
| 1,971,527 | 8/1934 | Kennedy | 261/44 A |
| 2,004,003 | 6/1935 | Kennedy | 261/55 |
| 2,214,273 | 9/1940 | Fish | 261/44 A |
| 3,132,191 | 5/1964 | Kennedy, Sr. | 261/41 B |
| 3,220,709 | 11/1965 | Pickron et al. | 261/44 A |
| 3,291,464 | 12/1966 | Hammerschmidt et al. | 261/44 A |
| 3,659,572 | 5/1972 | Pelizzoni | 261/DIG. 56 |
| 4,001,355 | 1/1977 | Day | 261/44 G |
| 4,108,117 | 8/1978 | Stumpp et al. | 261/44 A |
| 4,133,848 | 1/1979 | Black | 261/41 B |
| 4,139,583 | 2/1979 | Riley et al. | 261/DIG. 56 |
| 4,190,032 | 2/1980 | Wright | 261/DIG. 56 |

FOREIGN PATENT DOCUMENTS

| | | | |
|---|---|---|---|
| 325826 | 9/1920 | Fed. Rep. of Germany | 261/44 G |
| 55-1420 | 1/1980 | Japan | 261/44 G |
| 176335 | 1/1922 | United Kingdom | 261/44 G |

*Primary Examiner*—Tim R. Miles

*Attorney, Agent, or Firm*—Sughrue, Mion, Zinn, Macpeak & Seas

[57] ABSTRACT

A carburetor and valving therefor comprising a hollow tubular housing secured between top and base plates, said housing having outer and inner walls. A roller valve having a bore through the axis thereof and a radially extending pre-mixing chamber intersecting said bore is rotatably positioned within said housing by a pair of rods. The roller valve has a plurality of chordal ribs thereon, and spaces between said chordal ribs define air guides converging towards the opening of said pre-mixing chamber. One of said rods has a bore extending therethrough and opens into a larger bore at the inner end thereof. The circumference of the inner end of the rod has a rectangular cut-out therein, said cut-out having a flat wall through which a plurality of off-set orifices extend into the inner larger bore. The other of said rods has a reduced inner end portion having a chamber therein and a bore extending from the front face of the inner end extends into said chamber. A rectangular slot cut in the circumference of the reduced inner end has a knife-like edge thereon, said slot opens into the inner chamber.

12 Claims, 9 Drawing Figures

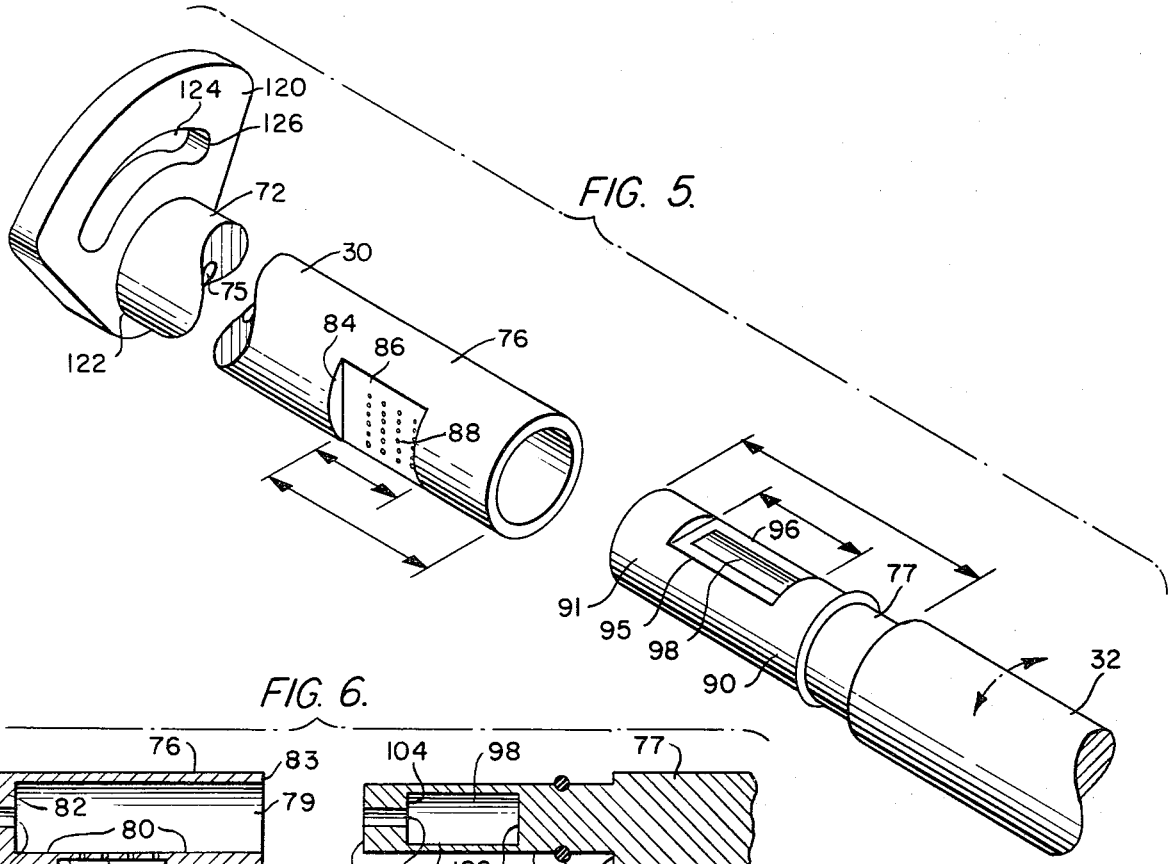
FIG. 5.
FIG. 6.
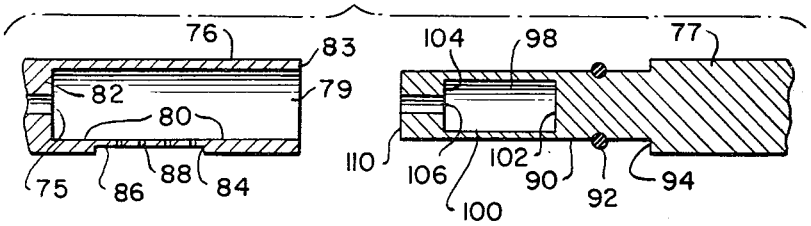
FIG. 7
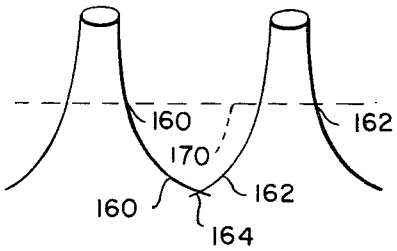
FIG. 8.
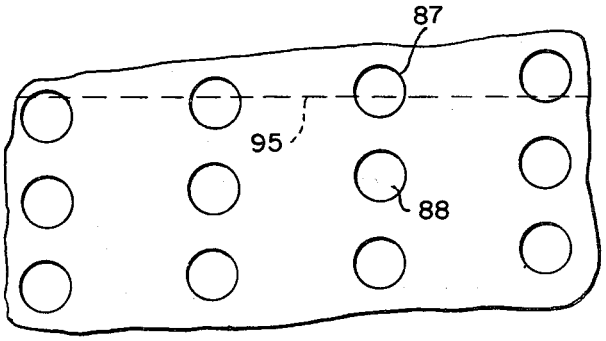
FIG. 9.
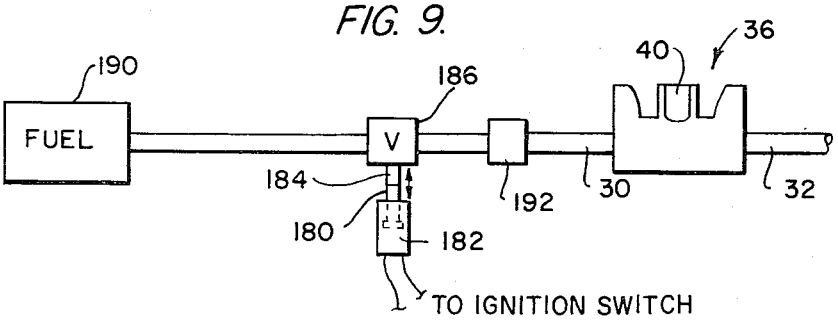

CARBURETOR AND VALVING THEREFOR

BACKGROUND OF THE INVENTION

1. Field of the Disclosure

This invention relates to a carburetor and unique valving therefor. A hollow tubular housing is provided having a valve in the form of a roller rotatably positioned within said housing. The roller valve has a bore through the axis thereof and a radially extending pre-mixing chamber intersects said bore. A pair of converging angular slots are provided in the roller valve which act as air guides whereby air is directed along said angular slots towards the pre-mixing chamber.

A pair of rods are telescopically interfitted at the inner ends thereof and support the roller valve for rotary movement within the tubular housing. One rod is provided with bores therethrough and radially extending orifices in the circumference thereof. A slot in the circumference of the inner reduced end of the other rod opens into a chamber and a bore through the end of the face of the reduced end opens into said chamber. The bores, chamber and orifices provide valving means for fuel to the pre-mixing chamber where it is mixed with air entering the pre-mixing chamber. The mixture of fuel passes into the lower chamber within the tubular housing where it is further mixed with additional air to achieve a perfect homogeneous mixture which enters the combustion chamber.

2. Statement of the Prior Art

In the prior art devices relating to carburetors, use of plural valves were necessary to provide for both vacuum and air-choke regulation. These devices also employed various valving arrangements and tortuous paths for regulating fuel flow into the carburetor. Some of the valving arrangements employed pin type valves whereby fuel flow regulation was achieved by adjusting the pin towards or away from an orifice. Other valving arrangements employed camming means for opening and closing a valve for regulating fuel flow. These devices have been operational to some degree but they are inefficient and do not provide precise metering and mixing of fuel and air to achieve economy and optimum operation of an engine at all operating conditions and speeds.

The following list of patents are submitted as being illustrative of the prior art:

| | | |
|---|---|---|
| M. Purvis et al | 1,688,285 | October 16, 1928 |
| G. L. Kennedy | 1,971,527 | August 28, 1934 |
| G. L. Kennedy | 2,004,003 | June 4, 1935 |
| J. R. Fish | 2,214,273 | September 10, 1940 |
| T. H. Pickron et al | 3,220,709 | November 30, 1965 |
| R. L. Hammerschmidt et al | 3,291,464 | December 13, 1966 |
| Stumpp et al | 4,108,117 | August 22, 1978 |

SUMMARY OF THE INVENTION

The present invention relates to a carburetor and the valving therefor and one object of the invention is to provide a carburetor which will be inexpensive to manufacture and which will be installed quickly and easily without the need for special expertise or tooling to do so.

A further object of this invention is to manufacture a carburetor which will be simple in contruction, have the least amount of moving parts and achieve greater fuel economy not herebefore possible.

A further object of this invention is to construct a carburetor which will permit exact and precise metering of fuel and air into the combustion chamber.

A further object of this invention is to construct a carburetor which will permit precise mixing of air and fuel to achieve a proper homogeneous mixture which will be rich during the initial starting condition but become more leaner as the speed of the engine increases.

A further object of this invention is to construct a unique valving mechanism which will permit automatic choke conditions without the need for conventional butterfly valves or the like presently used.

A further object of this invention is to provide a valve structure having a pre-mixing chamber therein and having unique physical characteristics as to facilitate optimum metering and mixing of air and fuel at all operating conditions of the engine.

A further object of this invention is to provide valving mechanisms whereby fuel is metered into the pre-mixing chamber in precise proportions according to the energy requirements of the engine at all operating conditions.

A further object of this invention is to construct a valving mechanism which will permit precise metering of fuel into the interior of the carburetor and to provide unique air flow means which will accomplish the breaking up of fuel so as to provide precise homogeneous mixture of fuel and air at all operating conditions.

By this construction, a rich mixture of air and fuel is possible at the initial starting condition of the engine, continuing during the idling condition but becoming leaner as the speeds of the engine increases to the upper range. Furthermore, this structure will permit an even leaner mixture of fuel and air during the higher speed ranges of the engine for the same amount of fuel as was used during the medium operating speeds of the engine.

Other and further objects of this invention will become apparent to those skilled in the art from a consideration of the following specification when read in conjunction with the annexed drawings.

BRIEF DESCRIPTION OF THE DRAWINGS

FIG. 5 is an exploded perspective view of the roller valve supporting rods showing valving means in the nature of bores, orifices and a slot;

FIG. 6 is a plan view of the rods inner end structures showing valving bores and orifices, reduced end section having a chamber and a bore, said rods are telescoped together to permit continuity of fluid flow into the premixing chamber of the roller valve;

FIG. 7 is a view of the fuel spray pattern as it emerges from the metering orifices;

FIG. 8 is a plan view of the off-set orifice arrangement showing the knife-like edge of the slot cutting across the orifices; and FIG. 9 is a block diagram showing a fuel pump, fuel valving, roller valve support tubing and roller valve.

DETAILED DESCRIPTION OF THE INVENTION

Figure 1:
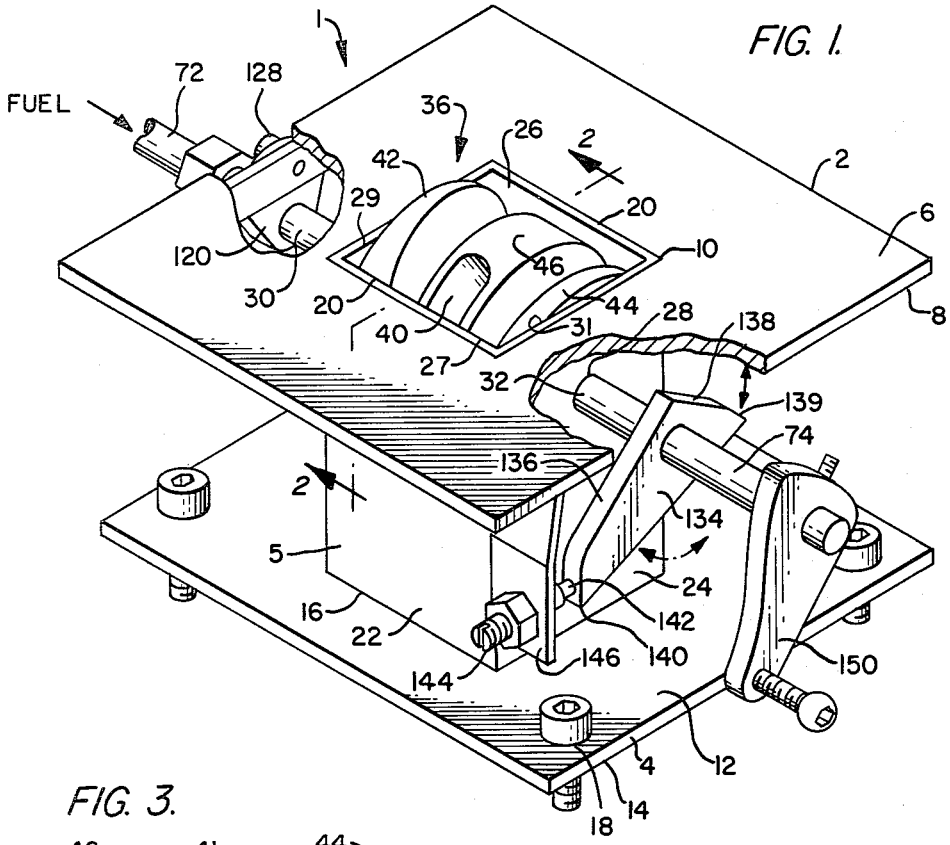
FIG. 1 is a perspective view of the carburetor and valving therefor.

Referring to the drawings in more detail, the carburetor 1 of this invention has a top plate 2, a base plate 4 and a hollow tubular housing 5 secured between the top plate 2 and the base plate 4. Top plate 2 has an upper side 6, lower side 8 and an aperture 10 centrally of the top plate 2. Base plate 4 has upper side 12, lower side 14, an aperture 16 centrally of the base plate and a plurality apertures 18 in each corner thereof for bolting the base plate to a manifold.

The hollow tubular housing 5 has an upper edge 20, lower edge 22, outer opposing walls 24 and inner walls 26, 27, 29 and 31. Apertures 28 in opposing walls 24 of the tubular housing 5 receive rods 30 and 32 therein. Lower edge 22 of tubular housing 5 is secured by welding or the like within the aperture 16 in the base plate 4. The base plate 4 is a ¾ inch aluminum plate having its lower side 14 machine polished so as to precisely correspond to the top polished surface of a manifold. By this construction, the tolerances between the plane of the bottom side 14 and the top surface of the manifold will be so precise as to eliminate vacuum leaks. Furthermore, this construction will eliminate the use of multi-gasket assemblies presently used in conventional carburetors.

Valve 36, FIGS. 1, 2, 3 and 4, is in the form of a roller having curved surface chordal ribs 42, 44 and 46. The curved surfaces of said ribs are continuous with curved sides 43 and 45 of the roller valve, the latter terminating at ledges 47 and 49 of a triangular base surface 51. A bore 38 extends through the axis of the roller valve 36 and a radially extending pre-mixing chamber 40 in rib 46 has a wide outer opening 41 and a small inner opening 43 intersects bore 38.

Outer chordal ribs 42 and 44 of the roller valve 36 have outer vertical walls 53 and 55 parallel with each other and inner converging walls 48 and 54. Chordal rib 46 has vertical walls 50 and 52 parallel with each other and the pre-mixing chamber 40 therein converges inwardly from the outer curved surface of the chordal rib towards the bore 38. Vertical walls 48, 50 and 52, 54 thus define air guides 60 and 62 having bottom surfaces 61 and 63 through which air flows from the wider ends 64 and 66 converging towards the narrower ends 68 and 70 creating high velocity swirling turbulence at opening 41 of the pre-mixing chamber.

Figure 2:
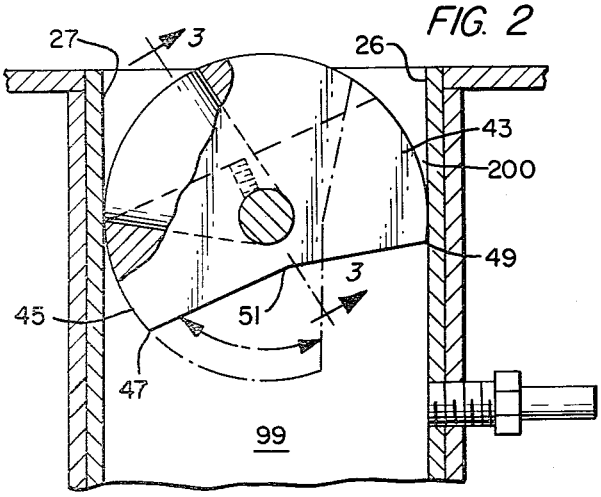
FIG. 2 is an end view of the roller valve taken along the line 2—2 of FIG. 1.
Figure 4:
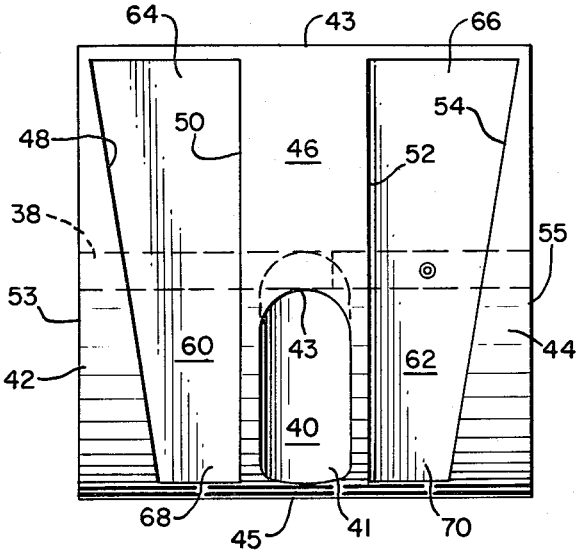
FIG. 4 is a plan view of the roller valve showing the converging air guides on either side of the pre-mixing chamber.

Roller valve 36 is rotatably positioned within the tubular housing 5, FIGS. 1 and 2, by means of rods 30 and 32 which extend through apertures 28 in opposing walls 24 of the housing and through the bore 38 of the roller valve. Vertical walls 53 and 55 of outer chordal ribs 42 and 44 abut against inner walls 29 and 31 of tubular housing 5 forming an air tight seal therebetween. Curved sides 43 and 45 of the roller valve 36 lie adjacent the inner walls 26 and 27 of the tubular housing 5. The diameter of the roller valve 36 between curved sides 43 and 45 is thousandts of an inch smaller than the distance between inner walls 26 and 27 so that minimum air passes between curved sides 43 and 45 and walls 26 and 27 when the roller valve 36 is in fully closed position. FIGS. 1 and 2.

Rods 30 and 32, FIGS. 1, 5 and 6, have outer ends 72 and 74 and inner ends 76 and 77. Rod 30 has a small bore 75 extending therethrough for the passage fuel from outer end 72 towards inner end 76. The bore opens into a larger bore 78 having circumferential inner wall 80, disc like end wall 82 and outer opening 79 having outer face 83. The circumference of inner end 76 of rod 30 has a rectangular cut-out 84 therein having a flat surface 86 through which a plurality of offset orifices 88 extend into the larger bore 78.

The inner end 77 of rod 32 has a reduced inner end portion 90 having an end section 91 and an O-ring 92 adjacent to vertical wall 94. Inner end 77 has a rectangular slot 96 cut therein having a knife-like edge 95. The slot opens into a chamber 98 within the reduced portion 90. Chamber 98 has inner walls 100, 102 and 104 and a bore 106 extends from within the chamber 98 through wall 104 to the outer face 110 of the reduced inner end portion 90.

Figure 3:
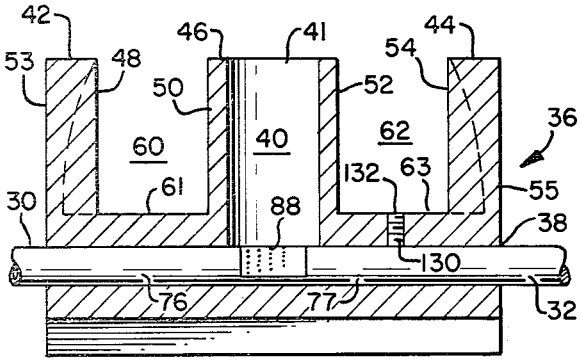
FIG. 3 is a side view of the roller valve and support means showing the air guides on either side of a pre-mixing chamber and the orifices in the support rod.

Inner end 76 of rod 30 extends a distance into the bore 38 of roller valve 36 such that the offset orifices 88 open into and lie adjacent the smaller opening 43 of said premixing chamber 40. The rod is adjustably secured to the wall of the housing so that the orifices remain fixedly oriented perpendicularly with respect to inner wall 27 of tubular housing 5. FIGS. 2 and 3. The reduced portion 90 of the inner end 77 of rod 32 extends into the bore 38 of roller valve 36 and telescopes into and rotates within the larger bore 78 of inner end 76 of rod 30. Face 110 of end section 91 abuts against disc-like wall 82 of larger bore 78 with bore 75 and bore 106 forming a continuous path for fuel to the pre-mixing chamber. Wall 94 of rod 32 abuts face 83 of rod 30 forming a seal therebetween. The diameter of section 91 of reduced portion 90 of rod 32 is machined so precisely that no fuel can pass between inner circumferential wall 80 of larger bore 78 of rod 32 and the circumference of section 91. O-ring 92 adds a further seal which prevents fuel from escaping through face 83 of the open end 78 of rod 30 and the wall 94 of rod 32.

Rod 30 is adjustably secured within the aperture 28 in wall 24 of tubular housing 5 by an adjusting bracket 120, FIGS. 1 and 5. Bracket 120 has an opening 122 therein into which is journaled outer end 72 of rod 30 and a second slot-like opening 124 has inner knurled surface 126. Bracket 120 with rod 30 journaled thereon is adjustably fixedly attached to wall 24 of tubular housing 5 by means of screw 128. By this arrangement the rod 30 may be precisely adjusted so that the orientation of the orifices 88 may be adjusted with respect to the pre-mixing chamber 40, their perpendicular orientation with respect to the inner wall 27 of the tubular housing 5, and with respect to the knife-like edge 95 of slot 98.

The roller valve 36 is fixedly secured to the inner end 77 of rod 30, FIG. 3, by a set screw 130 which extends through a hole 132 in the bottom wall 63 of air guide 62. Journaled on the outer end of rod 32 is a rotation range stop member 134 having sides 136, 138 and 139. Side 136 has a curved end 140 which abuts against an end 142 of an adjustable screw 144 which is threadedly rotatably mounted within a bracket 146 secured to wall 24 of tubular housing 5. Rotation of rod 32 and valve 36 in the open direction is limited when side 139 strikes side 8 of top plate 2. The number of orifices remaining exposed upon complete closing of valve 36 may be set by adjusting rod 30 through bracket 120 and by adjusting screw 144 the end of which abuts side 140 of the stop member 134. Journaled to the outer end of rod 32 is a bracket 150 to which is attached by suitable means the accelerator linkage (not shown).

The roller valve 36 is positioned for rotary movement within tubular housing 5 by being fixedly secured to the rotatable rod 32 in such a manner that the knife-like edge 95 of slot 98 lies adjacent the horizontal row 87 of orifices 88 exposing the orifices and cutting across the horizontal row such that the exposure of each adjacent orifice decreases from right to left across the row. FIG. 8. Thus, when the roller valve is in fully closed position, FIGS. 1, 2 and 5, the top right orifice is completely exposed with the remaining orifices in the row being exposed as described above. By this arrangement, fuel is immediately available for injection into the primary chamber during initial start up.

The spray pattern of fuel emerging from fully open orifices is shown in FIG. 7. Full spray pattern occurs when the leading edges 160 and 162 of the sprays (sprays for two orifices shown) intersect at 164. It is difficult to achieve a complete homogeneous mixture of fuel and air when the sprays from fully exposed orifices reach full spray pattern. It has been found through experimentation that much better break up and homogenation occurs when air is mixed with a fuel spray when the leading edges 160 and 162 of the spray pattern intersects line 170. The pressure of the spray at this intersecting line is much less than the pressure of the spray at line 164. Therefore, it is much easier to break up the fuel having a fuel spray pattern as seen as line 170 than as seen at line 164 due to the differences in their respective pressures. The present invention uses the least fully developed spray.

In the present invention, the diameter of the orifices 88 are such that the spray of fuel having a spray pattern as seen at line 170 emerges from the premixing chamber 40 to be mixed with air flowing along air guides 60 and 62 which channels air at a high velocity towards the outer opening 41 of the premixing chamber 40. Some of the air flowing along air guides 60, 62 bounces off inner wall 27 and enters the pre-mixing chamber in a swirling motion causing early breakup of the fuel spray prior to its emerging from the premixing chamber 40 where it is further broken up by the greater air velocity and turbulence which occurs at the outer opening 41 of the premixing chamber 40.

In fully closed position, the roller valve 36, is positioned as shown in FIGS. 1 and 2 whereby the premixing chamber 40 faces upwardly at an angle towards the top 20 and wall 27 of tubular housing 5. Curved sides 43 and 45 lie closely adjacent to walls 26 and 27 and vertical walls 53 and 55 of the outer chordal ribs 42, 44 effect an airtight seal between said vertical walls and walls 29 and 31 of the tubular housing 5. In this position, minimum air is allowed to pass between walls 26, 27 of tubular housing 5 and the curved surfaces 43 and 45 of the roller valve 36. These features effect elimination of choke valves which are used in conventional carburetors.

Upon turning of the ignition switch, FIG. 9, armature 180 of solenoid valve 182 advances against piston 184 of fuel valve 186 opening the fuel valve and allowing fuel under pressure from fuel pump 190 to pass therethrough. Regulation valve 192 regulates the fuel pressure to approximately 3 lbs. psi which flows through bores 75, 110 into chamber 94 through the orifices 88 exposed by the knife-like edge 95 and into the pre-mixing chamber 40. Air from the air guides enters the premixing chamber causing initial break-up of the fuel. The fuel and air mixture emerges through opening 41 of the pre-mixing chamber 40 and is further mixed with air of greater velocity and turbulence flowing along the air guides 60, 62 towards the opening 41 of the pre-mixing chamber.

Because of the roller valve structure, which limits and guides air flow within tubular housing 5; and the size of orifices 88, the position of knife-life edge 95 across the row 87 of orifices 88; a rich mixture of fuel is provided for the initial starting condition and continues during the early operating speeds of the engine. By this structure, no additional choke-valving is required at any temperature.

As the roller valve 36 turns on rod 32 within tubular housing 5, pre-mixing chamber 40 slowly turns into inner chamber 99 of tubular housing 5. Additional orifices become exposed as the knife-like edge 95 of slot 98 advances across the orifices thus exposing more of slot 98 to more orifices thus increasing the fuel discharged into the pre-mixing chamber 40 and subsequently into the inner chamber 99 of tubular housing 5. The size and arrangement of the orifices 88, the size of slot 96 and chamber 98 has been designed so that precise metering of fuel is achieved for all operating conditions and speeds of the engine. A richer mixture will be available during the initial starting of the engine and continues during the early operating speeds. The roller valve 36 is designed to channel the required amount of air along the air guides 60, 62 to achieve a proper homogeneous mixture of air and fuel at all operating conditions and temperatures of the engine.

As the roller valve turns in the open direction, the outer opening 41 of the pre-mixing chamber and the narrower edges 68, 70 of air guides 60, 62 opens into the lower chamber 99 of tubular housing 5 discharging the steadily increasing fuel mixture into said chamber. Increasingly greater air volume, velocity and turbulence occurs as the roller valve rotates in the open direction. It should be noted that edge 49 of curved side 43 of the roller valve 36 does not break away from close proximity with wall 26 of tubular housing 5 until the engine reaches the higher operating speeds, approximately 55 mph. At greater speeds, above 55 mph, the edge 49 begins to break away from wall 26 at approximately point 200, FIG. 2, opening a slot of increasing wider dimension allowing a great rush of high velocity air to flow between triangular base surface 51 and wall 26 creating violent turbulence of air within the inner chamber 99. This increasing rush of air and turbulence creates a much leaner mixture of fuel and air which is necessary at the upper operating speeds of the engine. Furthermore, it should be noted that no additional fuel is conveyed to the pre-mixing chamber and chamber 99 for these greater speeds because of the valving mechanism.

Maximum fuel is admitted into the pre-mixing chamber 40 and subsequently into the lower chamber 99 of tubular housing 5 when the edge 49 of triangular base 51 just breaks away from wall 26. This is the point of optimum operating condition of the engine with great fuel efficiency and economy being achieved because of the combined precise metering of fuel through chamber 98 and orifices 88 and the precise air metering and mixing as achieved by the roller valve 36 structure.

The spray pattern of fuel may be changed by changing the size of the orifices 88 so as to adopt this carburetor to other larger or smaller engines. Also, the diameter of the orifices 88 and the offset arrangement thereof permits the attainment of a perfect ratio of air and fuel mixture so as to eliminate flat spots which occur when the engine hesitates as when it is being starved of fuel. Thus, greater economy and efficiency is achieved for all operating conditions and speeds of the engine having this carburetor than was heretobefore possible with conventional carburetors. Furthermore, the dimension of the tubular housing may be changed to one having a different cross-sectional area, such as rectangular, triangular, or cylindrical which will attain the same benefits as heretofore described.

By attaching the carburetor to the manifold by the machined base plate 4, greater heat transfer occurs from the manifold to the carburetor. This results in the elimination of freezing of the fuel mixture during very cold temperatures. This construction also permits the elimination of vacuum leaks which is prevalent in conventional carburetors and which effects fuel economy. The top plate, base, tubular housing and roller valve of this carburetor are manufactured from aluminum material with the result that the coefficient of thermal expansion is the same for all operating temperatures. Thus, the manufacture of this carburetor is simple, inexpensive and results in greater efficiency and fuel economy being achieved than was heretofore possible.

What is claimed is:

1. A carburetor and valving therefor comprising:
a top plate;
a base plate;
a tubular housing having apertures in opposing walls thereof;
a roller valve rotatably positioned within said housing;
a bore extending through the axis of said valve, and a radially extending pre-mixing chamber intersecting said bore;
said roller valve having chordal ribs thereon;
a pair of rods extending through said apertures in said opposing walls and through said bore of said valve;
one of said rods having a small bore extending therethrough from the outer end thereof and opening into a larger bore at the inner end thereof, a rectangular cut-out in the circumference of said inner end having a flat wall surface through which extend a plurality of offset orifices into the larger bore;
the other of said rods having a reduced inner end, a rectangular slot cut in the circumference thereof and extending into a chamber within said reduced inner end, a knife-like edge on said slot, and a bore extending from the face of said reduced inner end opening into said chamber;
a fuel pressure regulator for said carburetor;
a metering valve for metering fuel to said pressure regulator, said metering valve operable by an armature of a solenoid, said solenoid operable from the ignition circuit of the engine; and
a fuel pump for providing fuel under pressure for said carburetor.

2. A carburetor and valving therefor as defined in claim 1, wherein:
said roller valve with said chordal ribs, the spaces between which defined air guides, having curved edges continuous with said chordal ribs and a triangular base.

3. A carburetor and valving therefor as defined in claim 2, wherein:
the larger bore of said one rod telescopically receiving the reduced inner end of said other rod, the face of said reduced inner end abutting the inner disc-like wall of the larger bore and said small bore of said one rod forming a continuous conduit with the bore of said other rod for metering fuel into said chamber in said other rod and subsequently through said orifices into the pre-mixing chamber.

4. A carburetor and valving therefor as defined in claim 1, wherein:
said knife-like edge on said slot abutting the rows of orifices exposing said orifices and cutting across the row of orifices progressively decreasing the exposure of said orifices from right to left along the row, thus allowing precise metering of fuel through said bores, chamber and orifices into said pre-mixing chamber and subsequently into the inner chamber of said tubular housing.

5. A carburetor and valving therefor as defined in claim 1, wherein:
said top plate, base plate and roller valve being extruded from aluminum material and said base plate machined so that the plane of said base plate precisely matches the top plane of an intake manifold of an engine to which said base plate is bolted.

6. A carburetor and valving therefor as defined in claim 1, wherein:
one of said rods is adjustably secured to one wall of said housing so that the perpendicular orientation of said orifices may be changed with respect to an inner wall of said housing and said knife-like edge of said slot.

7. A carburetor and valving therefor as defined in claim 1, wherein:
said orifices are dimensioned such that the fuel emerging from the premixing chamber being less than in full spray pattern whereby the leading edges of said sprays from said orifices are not touching each other thus facilitating early initial break up of said fuel sprays within the premixing chamber and easier subsequent break up of the mixture emerging from a premixing chamber.

8. A carburetor and valving therefor as defined in claim 1, wherein:
said rotation of said rod and roller valve being limited by stop means secured to the outer end of said rod and the number of orifices exposed to said slot being adjusted by an adjustable screw the end of which abuts a side of said stop means.

9. A carburetor and valving therefor comprising:
a tubular housing having inner and outer walls and apertures through said walls;
a roller valve rotatably positioned within said housing;
said roller valve having a bore extending through the axis thereof, and chordal ribs thereon having outer vertical walls, a pre-mixing chamber in one of said chordal ribs, and air guides converging towards said pre-mixing chamber;
a pair of rods telescopically interfitted, one of said rods being adjustably fixedly secured within an aperture in one wall of said housing and the other rod within the other aperture of said other wall rotatable with respect to said wall and to said one rod;
said rods supporting said roller valve for rotary movement within said tubular housing;
a bore extending through one of said rods opening into a larger bore at the inner end thereof, and a rectangular cut-out having a flat wall in the circumference of said inner end of said one rod, said flat wall having offset orifices therein and extending into said larger bore;

a reduced inner end portion on the other of said rods, a slot cut in the circumference of said reduced portion having a knife-like edge thereon, said slot opening into a chamber within said reduced portion, and a small bore extending into said chamber from the outer face of said reduced portion;

said larger bore telescopically receiving said reduced inner portion, said small bores forming a continuous conduit for fuel flow into said chamber and through said orifices into said pre-mixing chamber;

said fuel flow being mixed with air entering said pre-mixing chamber;

said mixture emerging from said pre-mixing chamber and being further mixed with air from said converging air guides;

said vertical walls of said chordal ribs forming an air tight seal with opposed inner walls of said housing; and said knife-like edge cutting across said orifices and advancing along columns of orifices upon rotation of said valve thus metering fuel flow in increasing proportions upon continued rotation of said roller valve in the open direction.

10. A carburetor and valving therefor comprising:

a tubular housing having opposed walls with apertures therein;

a roller valve within said housing having a bore through the axis thereof and a radially extending pre-mixing chamber therein intersecting the bore;

a plurality of air guides on said surface of said roller valve converging towards said pre-mixing chamber;

a pair of rods having a plurality of orifices therein extends into said housing, the inner ends of said rods extend through said bore in said valve, one rod held stationary and the other rotatable, said roller valve fixedly secured to said rotatable rod, and the inner end of said fixed rod telescopically receiving for rotation therein the inner end of said rotatable rod, said fixed rod and said rotatable rod supporting said roller valve for rotation within said housing;

a bore through one of said rods conducting fuel to the telescopically innerfitted connection, valving means within said telescopically innerfitted connection permitting fuel metering into said pre-mixing chamber;

air flow into said pre-mixing chamber breaking up and mixing the fuel sprays therein;

air flow along said air guides converging towards said pre-mixing chamber breaking up and mixing said mixture emerging from said pre-mixing chamber; and said mixture and said air from said air guides entering the chamber below said roller valve wherein additional mixing occurs before said mixture enters the combustion chamber.

11. A carburetor as defined in claim 10 wherein:

said valving means within said telescopically innerfitted connection comprising:

a pair of rods having outer and inner ends thereof, said inner ends extending through the apertures in said opposing walls of said housing;

one of said rods held stationary and having a bore therethrough extending from the outer end and opening into a larger bore at the inner end thereof, the circumference of said inner end having a rectangular cut-out therein, said cut-out having a flat surface through which extends a plurality of offset orifices opening into the larger bore, said small bore and said orifices defining fluid flow passages;

the other of said rods rotatable within the aperture in said opposed wall of said housing and having a reduced inner end, a rectangular slot cut in the circumference of said reduced inner end opening into a chamber therein, a knife-like edge in said slot and a small bore extending from the face of said reduced inner end into said chamber;

said reduced inner end inserted into said larger bore, the smaller bores forming a continuous conduit for fuel flow into said chamber, and said knife-like edge cutting horizontally across said orifices metering said fuel into said pre-mixing chamber; and said knife-like edge advancing along columns of orifices and cutting said orifices horizontally exposing a greater area of said slot to a greater number of orifices as the knife-like edge advances upon rotation of said other rod thus increasingly metering greater quantities of fuel into the pre-mixing chamber and subsequently into the chamber below said roller valve wherein it is mixed with additional air before entering the combustion chamber.

12. A carburetor and valving therefor as defined in claim 10, wherein:

said plurality of orifices being fixedly oriented perpendicularly with respect to said inner wall of said tubular housing, said air flowing through said air guides and between said inner walls of said tubular housing and said curved sides of said roller valve cutting said fuel sprays emerging from said pre-mixing chamber perpendicularly thus breaking up said sprays into a homogeneous mixture.

* * * * *